US009085167B2

(12) United States Patent
Kopp et al.

(10) Patent No.: US 9,085,167 B2
(45) Date of Patent: Jul. 21, 2015

(54) ARRANGEMENT TO SUPPLY A PRINT HEAD UNIT HAVING AT LEAST ONE PRINT HEAD WITH INK IN AN INK PRINTING APPARATUS

(71) Applicants: Martin Kopp, Munich (DE); Stefan Adelsperger, Walpertskirchen (DE); Thomas Szusdziara, Markt Schwaben (DE); Alexander Tobian, Augsburg (DE); Andre Schwarzkopf, Baldham (DE); Murat Kader, Munich (DE)

(72) Inventors: Martin Kopp, Munich (DE); Stefan Adelsperger, Walpertskirchen (DE); Thomas Szusdziara, Markt Schwaben (DE); Alexander Tobian, Augsburg (DE); Andre Schwarzkopf, Baldham (DE); Murat Kader, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/499,491

(22) Filed: Sep. 29, 2014

(65) Prior Publication Data

US 2015/0091992 A1 Apr. 2, 2015

(30) Foreign Application Priority Data

Sep. 30, 2013 (DE) ..... 10 2013 110 771

(51) Int. Cl.
*B41J 2/19* (2006.01)
*B41J 2/18* (2006.01)
*B41J 2/175* (2006.01)

(52) U.S. Cl.
CPC ..... *B41J 2/19* (2013.01); *B41J 2/17596* (2013.01)

(58) Field of Classification Search
None
See application file for complete search history.

(56) References Cited

U.S. PATENT DOCUMENTS

| | | | | |
|---|---|---|---|---|
| 7,281,778 | B2 | 10/2007 | Hasenbein et al. | |
| 2001/0017642 | A1 | 8/2001 | Shigemura | |
| 2007/0216739 | A1 | 9/2007 | Uchida et al. | |
| 2011/0285768 | A1 | 11/2011 | Preckel | |
| 2012/0140003 | A1 | 6/2012 | Szusdziara et al. | |
| 2013/0083099 | A1 * | 4/2013 | Anno | 347/7 |

FOREIGN PATENT DOCUMENTS

| | | | |
|---|---|---|---|
| DE | 102009020702 | A1 | 12/2010 |
| EP | 0788882 | B1 | 7/2002 |
| EP | 1938994 | B1 | 3/2010 |
| JP | 06183024 | A | 7/1994 |
| JP | 11207984 | A | 8/1999 |
| JP | 2005059476 | A | 3/2005 |
| JP | 2006205654 | A | 8/2006 |
| JP | 2011031128 | A | 2/2011 |

OTHER PUBLICATIONS

Machine Translation of JP 2005059476 A, Ink Feeding Device, Mar. 3, 2005.*

(Continued)

*Primary Examiner* — Lisa M Solomon
(74) *Attorney, Agent, or Firm* — Schiff Hardin LLP

(57) ABSTRACT

In an arrangement to supply ink to a print head unit having a print head, an input, and an output, a back-pressure tank having ink is provided and connected with the input of the print head unit. A degassing unit for ink and having an input and an output is also provided. A first selector valve is connected to the degassing unit input, the first selector valve in a first position establishing a connection of the degassing unit with the output of the print head unit. A second selector valve is connected to the degassing unit output, the second selector valve in a first position establishing a connection of the degassing unit with the back-pressure tank.

7 Claims, 3 Drawing Sheets

(56) References Cited

OTHER PUBLICATIONS

Machine Translation of JP 2006205564 A, Ink Feeding Device for InkJet Head, and InkJet Printing Device, Aug. 10, 2006.*

Abstract of JP JP 2006205564 A, Ink Feeding Device for InkJet Head, and InkJet Printing Device, Aug. 10, 2006.*

German Patent Office action dated Aug. 7, 2014.

* cited by examiner

ARRANGEMENT TO SUPPLY A PRINT HEAD UNIT HAVING AT LEAST ONE PRINT HEAD WITH INK IN AN INK PRINTING APPARATUS

BACKGROUND

Ink printing apparatuses can be used for single-color or multicolor printing of a printing substrate, for example a single sheet or a belt-shaped recording medium made of the most varied materials (paper, for example). The design of such ink printing apparatuses is known, see for example EP 0 788 882 B1. Ink printing apparatuses that operate according to the drop-on-demand (DoD) principle, for example, have a print head unit with one print head or multiple print heads in a printing unit, which print head or print heads provide(s) the nozzle units comprising ink channels and activators, wherein the activators—controlled by a printer controller—can excite ink droplets in the direction towards the recording medium, which ink droplets are drawn to the recording medium in order to apply print dots there for a print image. The activators can generate ink droplets thermally (bubble jet) or piezoelectrically.

The design of a print head that, for example, has nozzle units with piezoelectric activators is known from U.S. Pat. No. 7,281,778. Each nozzle unit comprises an ink channel that ends in a nozzle arranged in a nozzle plate, and provides an activator that is arranged at the ink channel. The recording medium is directed past the nozzle plate. If it should be printed, the activators provided for the printing are activated by a printer controller, which activators thereupon subject the ink in the ink channels to pressure waves via which the ejection of ink droplets from the nozzles is induced in the direction towards the recording medium.

The print heads of the print head unit must be continuously supplied with ink during the printing, which ink should advantageously be degassed. For this, the printing unit can provide a supply arrangement that, for example, can be designed according to US 2012/0140003 A1. The printing unit here provides multiple print bars having print heads, which print bars are respectively connected with a distributor. The distributors are for their part connected to a back-pressure tank in which ink is arranged under pressure so that ink can be transported into the distributor. Furthermore, the back-pressure tank is connected—via a pump and a filter—with a reservoir for ink. Ink is pumped from the reservoir into the back-pressure tank when the ink level in the back-pressure tank has dropped below a set height. For this, the ink level in the back-pressure tank can be measured. The ink in the reservoir can be supplemented from an ink bottle with the aid of a pump. The ink in the back-pressure tank can be degassed. For this, a degassing unit is provided that has a known degassing means and a pump. With the aid of the pump, ink is pumped back from the back-pressure tank via the degassing means into the back-pressure tank again, and thereby is degassed. This degassing process is implemented until the ink in the back-pressure tank has been degassed to a predetermined value.

An additional supply arrangement for ink in an ink printing apparatus is known from EP 1 938 994 B1. Here a back-pressure tank for ink is provided that is connected in the printing unit with the print heads in order to supply the print heads with ink. To supplement the ink in the back-pressure tank, this is connected via a pump with a reservoir for ink. The ink in the back-pressure tank can be degassed. For this, a degassing unit made up of a degassing means, a filter and a pump is provided. Ink from the back-pressure tank is directed back via the degassing unit into the back-pressure tank again, and is thereby degassed. The ink that is not consumed in the printing unit is directed into a sub-tank, and from there is conducted back via the degassing unit into the back-pressure tank.

SUMMARY

It is an object to specify an arrangement to supply an ink printing unit with ink, in which arrangement the ink supplied to the print head unit is reliably degassed, and in addition to this the ink is degassed upon filling and emptying of the supply arrangement.

In an arrangement to supply ink to a print head unit having a print head, an input, and an output, a back-pressure tank having ink is provided and connected with the input of the print head unit. A degassing unit for ink and having an input and an output is also provided. A first selector valve is connected to the degassing unit input, the first selector valve in a first position establishing a connection of the degassing unit with the output of the print head unit. A second selector valve is connected to the degassing unit output, the second selector valve in a first position establishing a connection of the degassing unit with the back-pressure tank.

DESCRIPTION OF EXEMPLARY EMBODIMENTS

Figure 1:
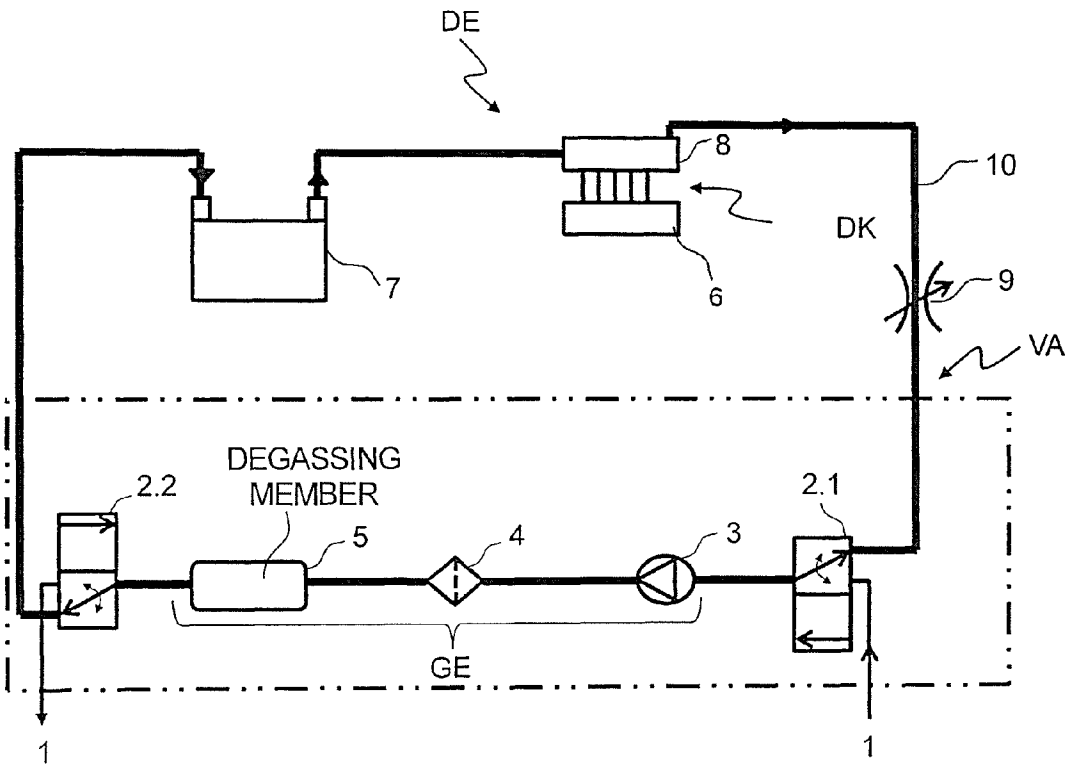
FIG. 1 is a principle depiction of a supply arrangement for ink in a printing unit of an ink printing apparatus in which the ink supplied to the print head unit from the back-pressure tank is degassed.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

The arrangement to supply a print head unit having print heads and a distributor with ink in an ink printing apparatus (also called a supply arrangement in the following) comprises a back-pressure tank that is connected with the print head unit to supply ink; a reservoir for ink; and a degassing unit to degas the ink. A multipath first and second selector valves are respectively provided before and after the degassing unit. The first selector valve and the second selector valve can be set so that

- the ink supplied to the print head unit is degassed,
- in the filling of the supply arrangement with ink, this is extracted from the reservoir, directed via the degassing unit and then supplied to the back-pressure tank, in the emptying of the supply arrangement of ink, this is transported via the degassing unit to the storage container.

Advantages of the exemplary embodiment are:

The ink in the printing unit can be degassed up to just before the print heads of the print head unit.

A better print quality can be achieved after longer downtime of the printing apparatus.

No ink that is not used in the print head unit is discarded; rather, this is directed back into the reservoir.

The printing unit can be emptied and filled markedly more quickly and easily in the event of service.

The first filling of the printing unit can be automated.

Figure 2:
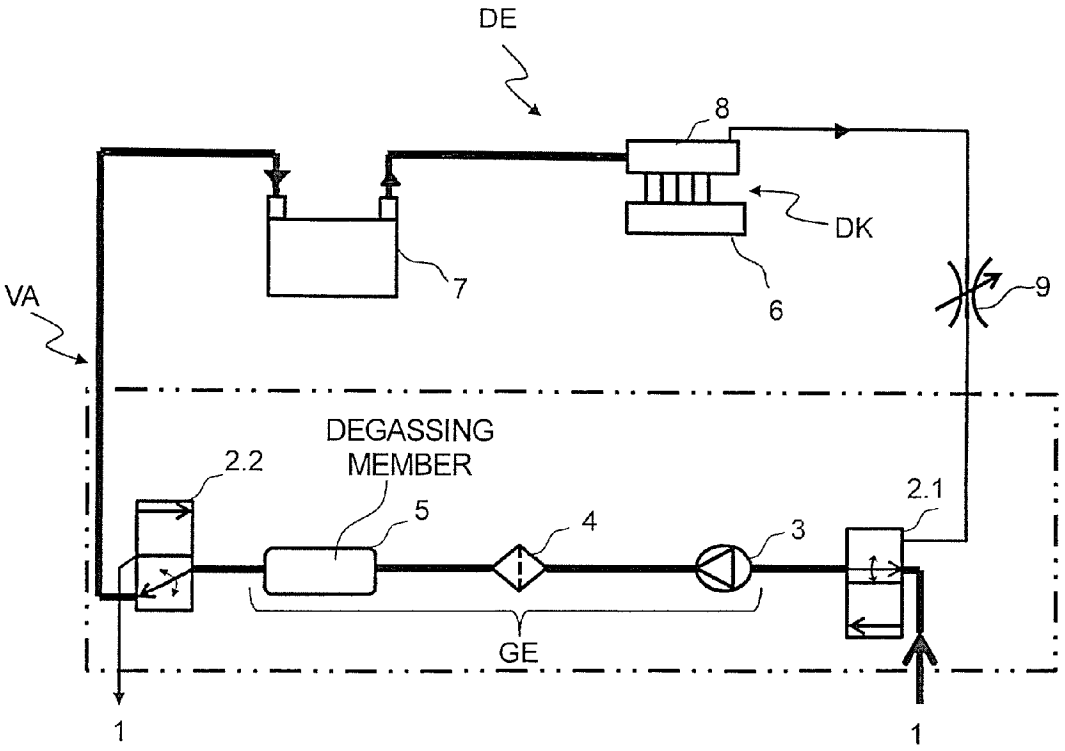
FIG. 2 is a principle depiction of a supply arrangement for ink in a printing unit in which the ink is degassed in the filling of the supply arrangement.
Figure 3:
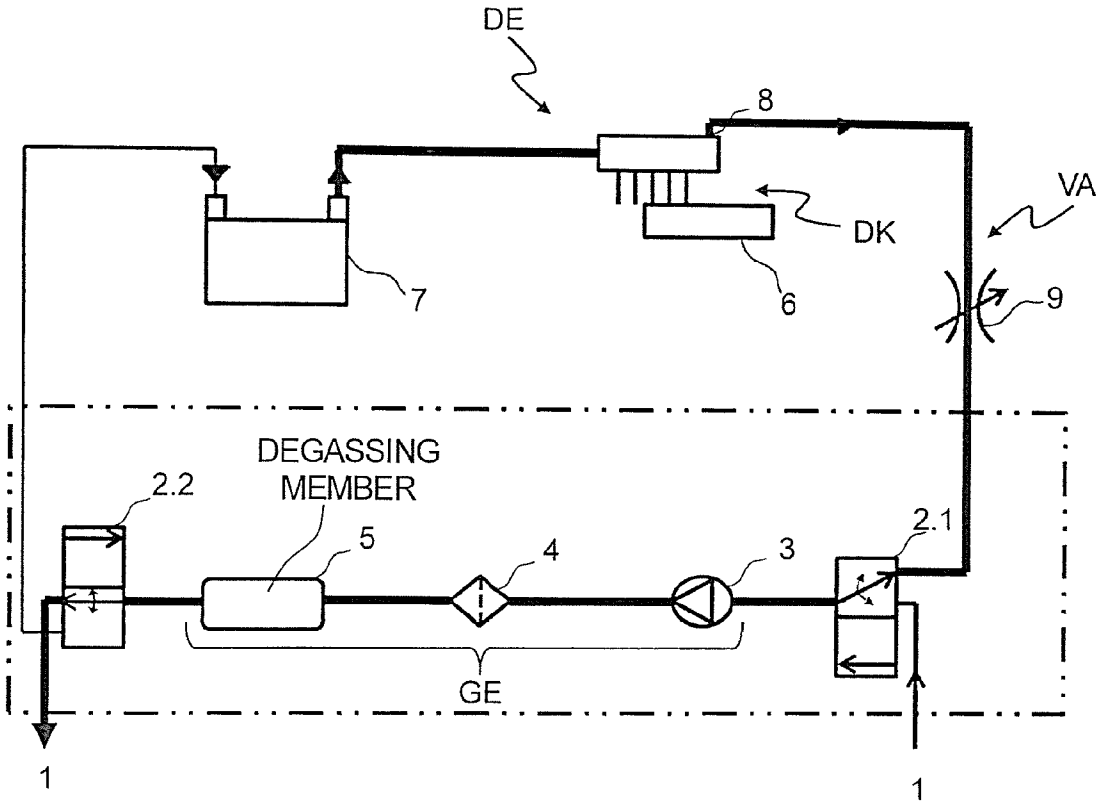
FIG. 3 is a principle depiction of a supply arrangement for ink in a printing unit in which the ink is degassed upon emptying the supply arrangement and is directed back into the reservoir.

The exemplary embodiments are shown in FIGS. 1-3. The degassing unit GE with a degassing member 5, a pump 3 and a filter 4 is of known design—refer in this regard to U.S. 2012/0140003 A1; and its function is also explained there.

Via the setting of the selector valves 2.1, 2.2:

the ink that is not consumed by the print head unit DK can be transported back from the distributor 8 to the back-pressure tank 7 and thereby be degassed (first exemplary embodiment of the degassing unit GE);

in the filling of the supply arrangement VA with ink from the reservoir 1, the ink can be degassed on the way from the reservoir 1 to the back-pressure tank 7 (second exemplary embodiment of the degassing unit GE);

in the emptying of the supply arrangement VA, the ink from the back-pressure tank 7 and the distributor 8 into the reservoir 1 can be degassed (third exemplary embodiment of the degassing unit GE).

For example, the selector valves 2.1, 2.2 can be realized as 3/2-way valves with the aid of which a conduit for ink can be switched to two different supply lines.

Degassing the ink supplied to the print head unit DK, for example the ink that is not consumed by the print head unit DK and is supplied back to the back-pressure tank 7 (first exemplary embodiment; FIG. 1) can be accomplished by the following. To degas the ink supplied to the distributor 8 of the print head unit DK, the first selector valve 2.1 is set so that the output of the distributor 8 is connected with the degassing unit GE. Furthermore, the second selector valve 2.2 is switched so that the output of the degassing unit GE is connected with the input of the back-pressure tank 7. With the aid of the pump 3, ink can then be conducted from the distributor 8 across the filter 4 and the degassing member 5, and be conducted from there into the back-pressure tank 7. The ink that is supplied from the back-pressure tank 7 to the distributor 8 (and therefore to the print heads 6) is thereby also degassed. The degassing capability of the degassing unit GE can additionally be increased in that the volume flow of the ink across the degassing unit GE is reduced. This influencing of the volume flow can be achieved via a choke 9 introduced into the conduit 10 between the distributor 8 and the first selector valve 2.1; via regulation of the capacity of the pump 3; or via reduction of the cross section of, for example, the supply line 10 between the distributor 8 and the for example 2.1.

The degassing loop can be started by activating the pump 3. The ink is then conveyed through the filter 4 and the degassing member 5 into the back-pressure tank 7. From there, the degassed ink arrives in the distributor 8 and at the print heads 6. Unconsumed ink is supplied via the distributor 8 and the selector valve 2.1 to the degassing unit GE again. This degassing cycle can run until the desired degree of degassing is achieved in the distributor 8.

Degassing of the ink during filling of the supply arrangement VA (second exemplary embodiment; FIG. 2) will now be described.

Here the input of the first selector valve 2.1 is switched to the reservoir 1 while the second selector valve 2.2 switches the output of the degassing unit GE to the back-pressure tank 7. During conveying the ink from the reservoir 1 into the back-pressure tank 7, the ink is directed across the degassing unit GE and is thereby degassed. Degassed ink is thus supplied from the reservoir 1 to the back-pressure tank 7. The degassed ink can then be conducted to the distributor 8.

The filling of the supply arrangement VA is started by activating the pump 3. After filling the back-pressure tank 7, the remaining components of the print head unit DK (for example the distributor 8 or the print heads 6) can subsequently be filled, corresponding to exemplary embodiment a). The requirement is that the ink volume of the back-pressure tank 7 is sufficiently large in order to fill the components between the back-pressure tank 7 and the pump 3 with ink.

Degassing of the ink during emptying the supply arrangement VA (third exemplary embodiment; FIG. 3) will now be described. Now the input of the first selector valve 2.1 is switched to the distributor 8 while the second selector valve 2.2 switches the output of the degassing unit GE to an input of the reservoir 1. Upon conveying the ink from the back-pressure tank 7 into the reservoir 1, the ink is directed across the degassing unit GE and is thereby degassed. Degassed ink is thus supplied from the back-pressure tank 7 and the print head unit DK to the reservoir 1.

The emptying of the supply arrangement VA is started by activating the pump 3. The content of the back-pressure tank 7 and of the print head unit DK is thereby conveyed via the degassing unit GE into the reservoir 1.

The setting of the selector valves 2.1 and 2.2 is shown in FIG. 1 through 3; and the transport path of the ink is marked in bold in FIG. 1 through 3.

The individual components of the supply arrangement VA are of known design, for example; for this, refer to U.S. 2012/0140003 A1.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. An arrangement to supply ink to a print head unit having a print head, said print head unit having an input and an output, in an ink printing apparatus, comprising:

a back-pressure tank having ink and that is connected with said input of the print head unit via a supply line;

a degassing unit for ink and having an input and an output;

a first selector valve connected to said degassing unit input, said first selector valve when switched in a first position establishing a connection of the degassing unit with the output of the print head unit;

a second selector valve connected to said degassing unit output, said second selector valve in a first position establishing a connection of the degassing unit with the back-pressure tank;

the degassing unit having a pump, a filter, and a degassing member for ink;

the print head unit having a plurality of said print heads and a distributor to supply the individual print heads with ink, and wherein the first selector valve is connected with an output of the distributor as said print head unit output; and the first selector valve when switched into a second position with the second selector valve switched into the first position filling the supply arrangement with ink.

2. The arrangement according to claim 1 in which the first selector valve is also connected with an output of a reservoir in order to connect the reservoir to the degassing unit in said second position of said first selector valve.

3. The arrangement according to claim 2 in which the second selector valve is also connected with an output of the reservoir in order to connect the degassing unit to the reservoir in a second position of the second selector valve.

4. The arrangement according to claim 3 in which the first selector valve and the second selector valve are connected in their respective first positions to degas the ink in the supply line between the back-pressure tank and the distributor.

5. An arrangement to supply ink to a print head unit having a print head, said print head unit having an input and an output, in an ink printing apparatus, comprising:

a back-pressure tank having ink and that is connected with said input of the print head unit via a supply line;

a degassing unit for ink and having an input and an output;

a first selector valve connected to said degassing unit input, said first selector valve in a first position establishing a connection of the degassing unit with the output of the print head unit;

a second selector valve connected to said degassing unit output, said second selector valve in a first position establishing a connection of said degassing unit with the back-pressure tank;

the degassing unit having a pump, a filter, and a degassing member for ink;

the print head unit having print heads and a distributor to supply the individual print heads with ink, and wherein the first selector valve is connected with an output of the distributor as said print head unit output;

the first selector valve also being connected with an output of a reservoir in order to connect the reservoir to the degassing unit in a second position of said first selector valve:

the second selector valve also being connected with an input of the reservoir in order to connect the degassing unit to the reservoir at a second position of the second selector valve;

the first selector valve and the second selector valve being connected in their respective first positions to degas the ink in a supply line between the back-pressure tank and the distributor; and a choke introduced into a conduit from the distributor to the first selector valve.

6. An arrangement to supply ink to a print head unit having a print head, said print head unit having an input and an output, in an ink printing apparatus, comprising:

a back-pressure tank having ink and that is connected with said input of the print head unit via a supply line;

a degassing unit for ink and having an input and an output;

a first selector valve connected to said degassing unit input, said first selector valve in a first position establishing a connection of the degassing unit with the output of the print head unit;

a second selector valve connected to said degassing unit output, said second selector valve in a first position establishing a connection of the degassing unit with the back-pressure tank;

the degassing unit having a pump, a filter, and a degassing member for ink;

the print head unit having print heads and a distributor to supply the individual print heads with ink, and wherein the first selector valve is connected with an output of the distributor as said print head unit output; and the first selector valve being switched into the first position and the second selector valve being switched into a second position to empty the ink from the supply arrangement.

7. An arrangement to supply ink to a print head unit having a print head, said print head unit having an input and an output, in an ink printing apparatus, comprising:

a back-pressure tank having ink and that is connected with said input of the print head unit via a supply line;

a degassing unit for ink and having an input and an output;

a first selector valve connected to said degassing unit input, said first selector valve in a first position establishing a connection of the degassing unit with the output of the print head unit;

a second selector valve connected to said degassing unit output, said second selector valve in a first position establishing a connection of the degassing unit with the back-pressure tank;

said first selector valve also having a second position for feeding ink from a reservoir to said input of said degassing unit and then to said back-pressure tank through said second selector valve in said first position; and said second selector valve also having a second position such that ink from said print head unit is fed through said first selector valve in said first position to said input of said degassing unit and then to said reservoir through said second selector valve in said second position of said second selector valve.

* * * * *